US011118584B2

(12) United States Patent
Miller et al.

(10) Patent No.: US 11,118,584 B2
(45) Date of Patent: Sep. 14, 2021

(54) RING SECTION PUMP HAVING INTERMEDIATE TIE ROD COMBINATION

(71) Applicant: ITT MANUFACTURING ENTERPRISES LLC., Wilmington, DE (US)

(72) Inventors: Daniel S. Miller, Ontario, CA (US); Abhi N. Gandhi, South Pasadena, CA (US); Paul W. Behnke, Seal Beach, CA (US)

(73) Assignee: ITT Manufacturing Enterprises LLC, Wilmington, DE (US)

( * ) Notice: Subject to any disclaimer, the term of this patent is extended or adjusted under 35 U.S.C. 154(b) by 804 days.

(21) Appl. No.: 15/196,418

(22) Filed: Jun. 29, 2016

(65) Prior Publication Data

US 2018/0003177 A1 Jan. 4, 2018

(51) Int. Cl.
*F04C 19/00* (2006.01)
*F04D 1/06* (2006.01)
(Continued)

(52) U.S. Cl.
CPC ..... *F04C 19/005* (2013.01); *F04C 7/00* (2013.01); *F04C 19/001* (2013.01); *F04D 1/066* (2013.01);
(Continued)

(58) Field of Classification Search
CPC ..... F04C 19/005; F04C 19/00; F04C 19/001; F04C 19/007; F04C 19/008; F04C 29/00; F04C 2240/30; F04D 1/066; F04D 29/628
(Continued)

(56) References Cited

U.S. PATENT DOCUMENTS 2,281,631 A * 5/1942 Spillmann ..... F04D 1/063 415/108
3,494,669 A 2/1970 Reppert
(Continued)

FOREIGN PATENT DOCUMENTS

DE 1109527 B 6/1961
GB 933185 A 8/1963
(Continued)

OTHER PUBLICATIONS

DE1109527 English language abstract unavailable.
(Continued)

*Primary Examiner* — Woody A Lee, Jr.
(74) *Attorney, Agent, or Firm* — Carter, DeLuca & Farrell LLP; Bret P. Shapiro; George Likourezos

(57) ABSTRACT

A ring section pump features a low-pressure end configured to receive fluid to be pumped into the ring section pump; a high-pressure end configured to provide the fluid to be pumped from the ring section pump; and an intermediate tie rod combination having a intermediate flange with upper tie rods configured to couple together the intermediate flange and the high-pressure end and with lower tie rods configured to couple together the intermediate flange and the low-pressure end. The low-pressure end has an inlet flange; the high-pressure end has an outlet/discharge flange; and the upper tie rods couple together the intermediate flange and the outlet/discharge flange and the lower tie rods couple together the intermediate flange and the inlet flange.

9 Claims, 6 Drawing Sheets

(51) Int. Cl.
*F04D 29/62* (2006.01)
*F04C 7/00* (2006.01)

(52) U.S. Cl.
CPC ..... *F04D 29/628* (2013.01); *F04C 2240/20* (2013.01); *F05D 2260/31* (2013.01)

(58) Field of Classification Search
USPC ..... 415/199.1
See application file for complete search history.

(56) References Cited

U.S. PATENT DOCUMENTS

| | | | | |
|---|---|---|---|---|
| 3,722,338 | A | 3/1973 | Cherel | |
| 3,820,851 | A | 6/1974 | Longo et al. | |
| 4,047,871 | A | 9/1977 | Klehl | |
| 4,089,229 | A | 5/1978 | Geraci | |
| 4,090,822 | A | 5/1978 | Mount et al. | |
| 4,242,057 | A | 12/1980 | Bender | |
| 4,382,750 | A | 5/1983 | Robertson et al. | |
| 4,500,267 | A | 2/1985 | Birdwell | |
| 4,541,779 | A | 9/1985 | Birdwell | |
| 5,201,633 | A * | 4/1993 | Peu | F04D 1/066 137/565.33 |
| 5,299,880 | A | 4/1994 | Bouchard | |
| 5,616,009 | A | 4/1997 | Birdwell | |
| 5,626,502 | A | 5/1997 | Novey | |
| 5,643,458 | A | 7/1997 | Nagaoka | |
| 5,785,391 | A | 7/1998 | Parry et al. | |
| 5,954,956 | A | 9/1999 | Lutz et al. | |
| 7,238,773 | B2 | 7/2007 | Huebinger et al. | |
| 7,296,981 | B2 | 11/2007 | Strong | |
| 2003/0003178 | A1 | 1/2003 | Kami et al. | |
| 2012/0164004 | A1 | 6/2012 | Thomeer et al. | |
| 2015/0300557 | A1 | 10/2015 | Ajam et al. | |
| 2015/0330391 | A1* | 11/2015 | Bergamini | F04D 1/066 415/198.1 |
| 2018/0223854 | A1* | 8/2018 | Brunvold | F04D 1/003 |
| 2020/0271126 | A1* | 8/2020 | Kunishi | F04D 29/628 |

FOREIGN PATENT DOCUMENTS

| | | | |
|---|---|---|---|
| JP | S6440713 | A | 2/1989 |
| JP | H05-31018 | A | 2/1993 |
| JP | 2014-185523 | A | 10/2014 |
| WO | 8603560 | | 6/1986 |
| WO | 2006091436 | | 8/2006 |
| WO | 2013143446 | A1 | 10/2013 |

OTHER PUBLICATIONS

Japanese Office Action issued in corresponding Japanese Application No. JP2018-568416, dated Feb. 2, 2021, pp. 1-10, together with English translation.

* cited by examiner

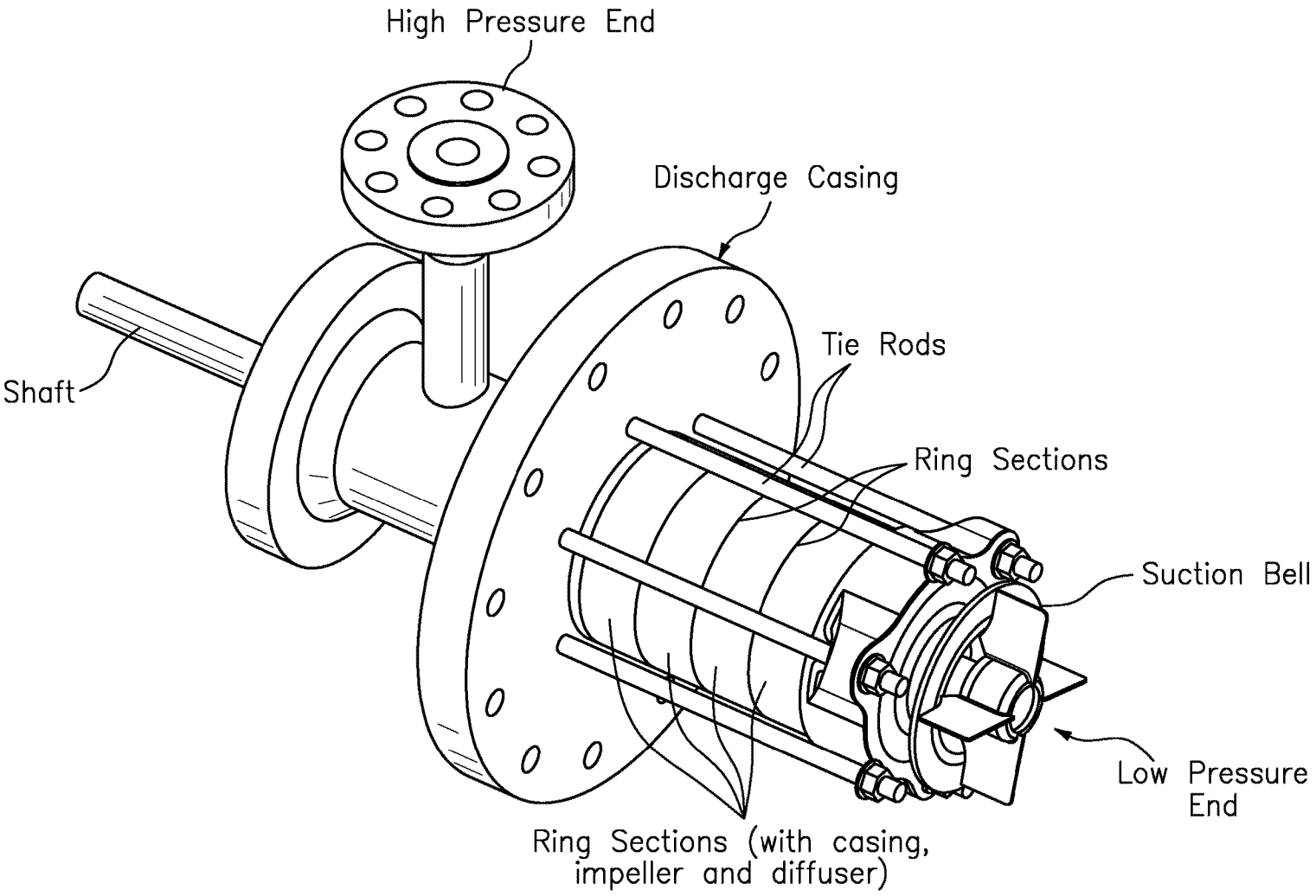
*FIG. 1A*: Ring Section Pump Having Conventional Tie–Rod Design (PRIOR ART)

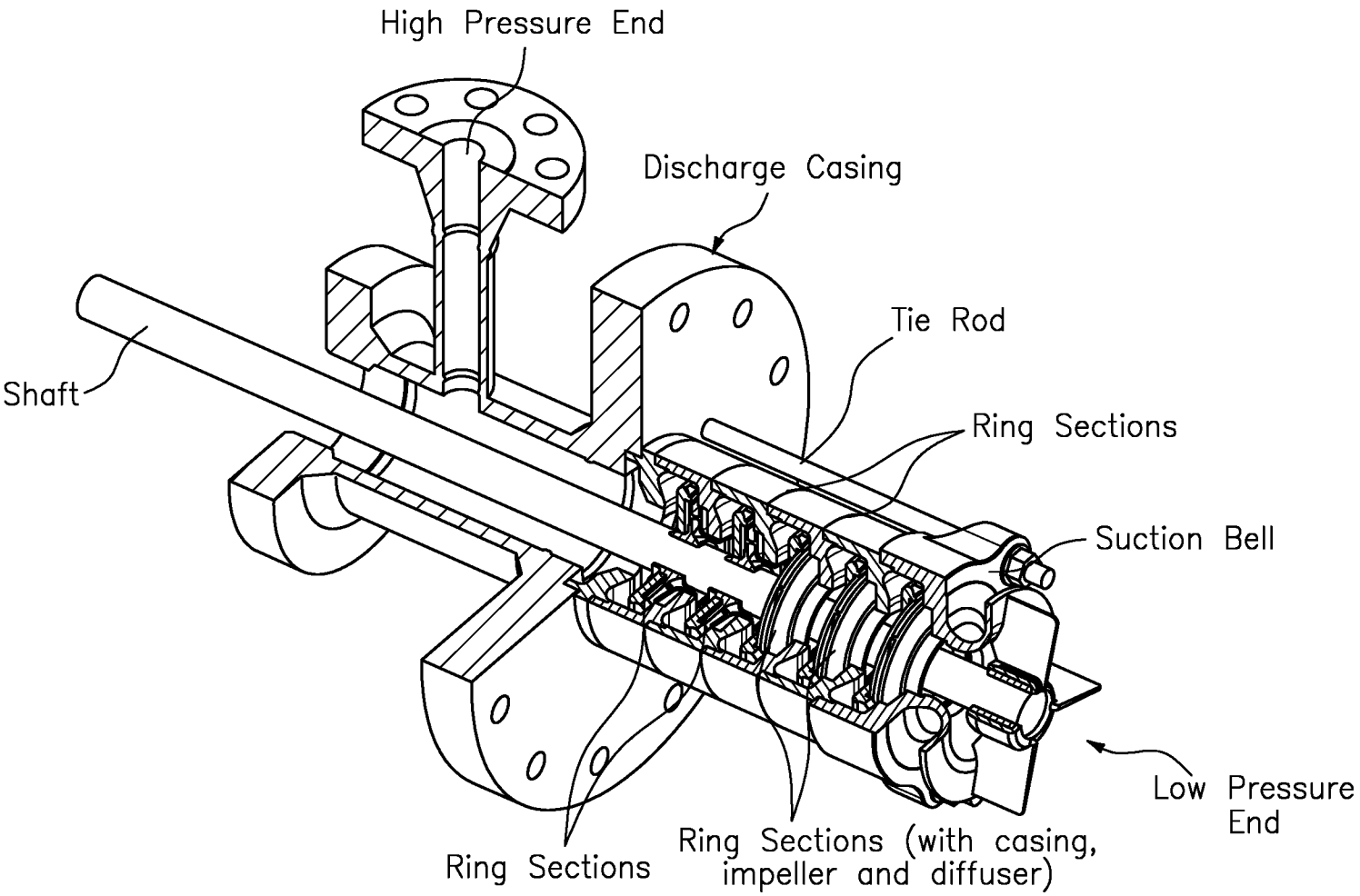
*FIG. 1B*: Original Design

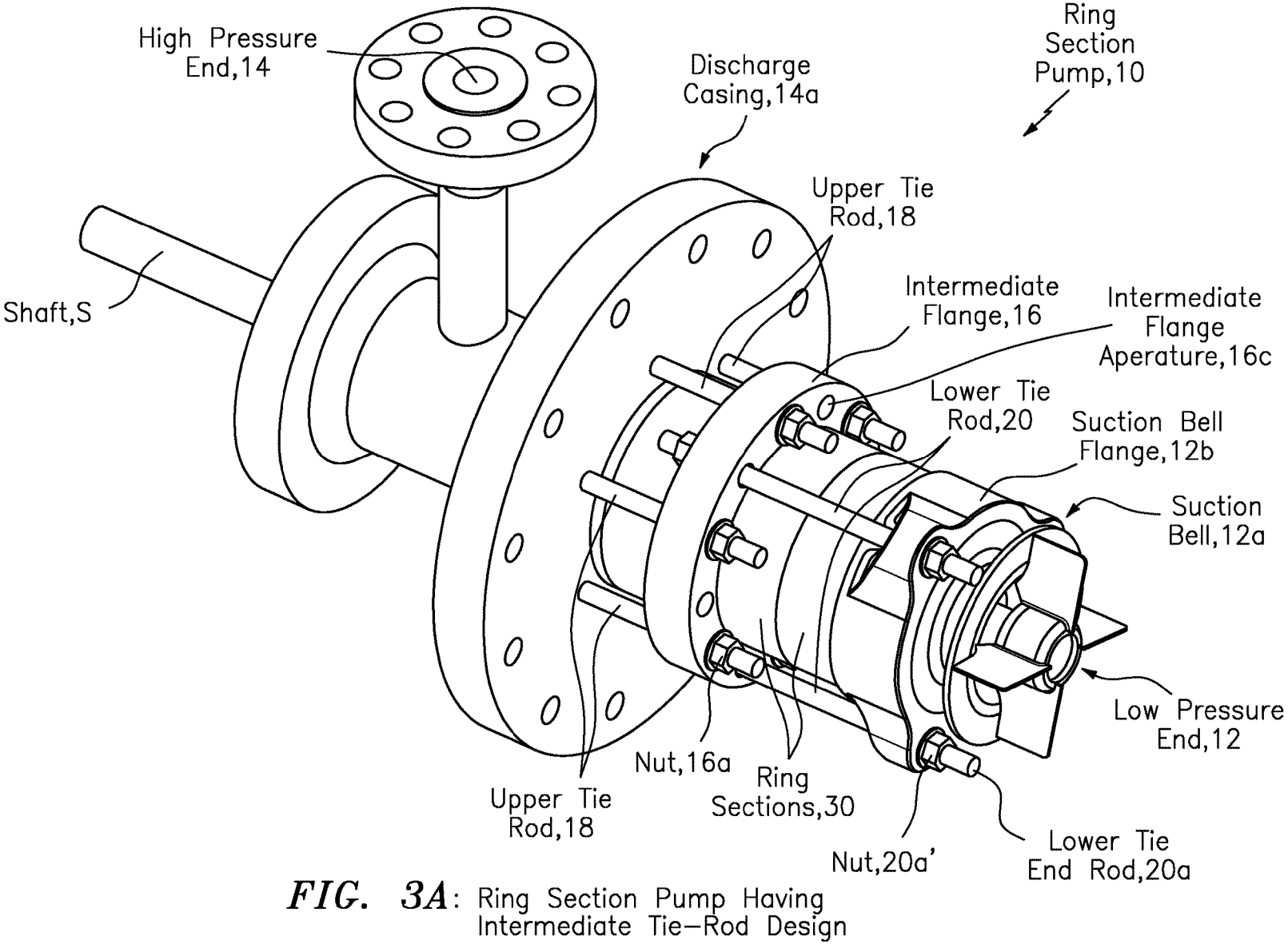
*FIG. 3A*: Ring Section Pump Having Intermediate Tie-Rod Design

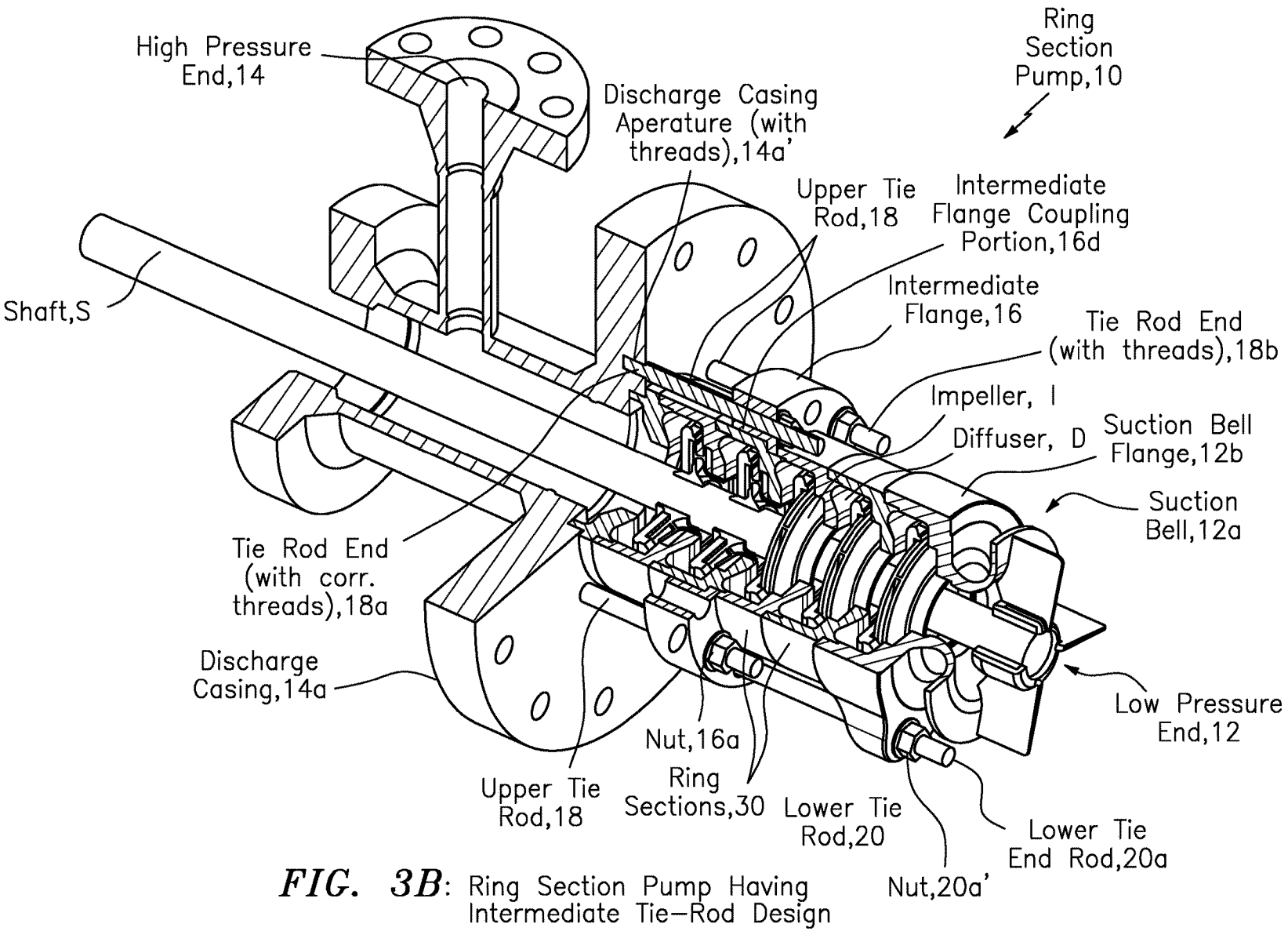
*FIG. 3B*: Ring Section Pump Having Intermediate Tie–Rod Design

RING SECTION PUMP HAVING INTERMEDIATE TIE ROD COMBINATION

BACKGROUND OF THE INVENTION

1. Field of the Invention

This application relates to a pump; and more particularly to a ring section pump having tie rods.

2. Brief Description of Related Art

By way of example, FIGS. 1A and 1B and FIGS. 2A and 2B show ring section tie-rod pump that are known in the art. FIGS. 1A and 1B show a ring section tie-rod pump, e.g., that may be vertically arranged, mounted and used in relation to a sump. In comparison, FIGS. 2A and 2B show a ring section tie-rod pump, e.g., that may be horizontally-mounted and used in relation to other pumping applications.

Traditional ring section tie-rod pumps are built with tie-rods extending the full length of all stages. This solution is adequate for shorter pumps; however, for longer pumps this arrangement becomes difficult to assemble, subject to more resonant vibration problems and costly due to tie rods having to handle the full pressure of the whole pump. Long spans of tie rods are also less able to resist twisting of ring section assembly. In effect, the current design is limited to only a single size of tie-rod that spans the entire length of pump assembly.

In view of this, there is a need in the industry for a ring section tie-rod pump having a better tie rod arrangement that eliminates the aforementioned problems with the known ring section tie-rod pumps.

SUMMARY OF THE INVENTION

In summary, the present invention provides a technique for installing one or more intermediate flanges or pieces that accept tie-rod terminations in a similar manner as pump assembly ends, and from both sides.

Assembly difficulty is alleviated by the present invention by reducing the span between tie-rod ends. The assembly process is safer due to the reduction of unsupported stages before installing tie-rods. This also results in better component alignment for the pump and easier measurement of alignment between shorter spans.

The present invention also provides a solution to potential structural vibration problems. This arrangement allows for greater options for changing natural frequency of pump structure to reduce resonant vibrations. The present invention is an optimized solution to pressure handling capabilities of the ring-section pump. This allows for a reduction of tie-rods for low pressure sections of the pump. Also this allows an increase in stages and pressure handling without costly material addition. The invention also reinforces the pump assembly more in the region that the ring-sections experience the highest between ring-section torque (force trying to spin sections relative to each other).

Specific Embodiments of the Present Invention

According to some embodiments, the present invention may take the form of apparatus, e.g., including a ring section pump, featuring

- a low-pressure end configured to receive fluid to be pumped into the ring section pump;

- high-pressure end configured to provide the fluid to be pumped from the ring section pump; and
- at least one intermediate tie rod combination having at least one intermediate flange with upper tie rods configured to couple together the at least one intermediate flange and the high-pressure end and with lower tie rods configured to couple together the at least one intermediate flange and the low-pressure end.

The apparatus may include one or more of the following features:

The low-pressure end may include an inlet flange; the high-pressure end may include an outlet/discharge flange; and the upper tie rods may couple together the at least one intermediate flange and the outlet/discharge flange, and the lower tie rods may couple together the at least one intermediate flange and the inlet flange.

The outlet/discharge flange may be configured with apertures to receive ends of the upper tie rods. By way of example, the outlet/discharge flange may be configured with threaded apertures to receive threaded ends of the upper tie rods to couple together the outlet/discharge flange and the upper tie rods.

The inlet flange may be configured with corresponding apertures to receive corresponding ends of the lower tie rods. By way of further example, the inlet flange may be configured so the corresponding apertures allow threaded corresponding ends of the lower tie rods to be passed through and fastened to the inlet flange with corresponding threaded nuts.

The at least one intermediate flange may be configured with a first set of associated apertures to receive opposing ends of the upper tie rods to couple together the at least one intermediate flange and the outlet/discharge flange, and may also be configured with a second set of associated apertures to receive opposing corresponding ends of the lower tie rods to couple together the at least one intermediate flange and the inlet flange.

The first set of associated apertures may be configured to allow threaded opposing ends of the upper tie rods to be passed through and fastened to the at least one intermediate flange with a first set of associated threaded nuts.

The second set of associated apertures may be configured to allow threaded opposing corresponding ends of the lower tie rods to be passed through and fastened to the at least one intermediate flange with a second set of associated threaded nuts.

The at least one intermediate flange may include at least one intermediate flange coupling portion; and the ring section pump may include adjacent ring sections or stages configured to receive and engage the at least one intermediate flange coupling portion at at least one intermediate location between the high-pressure end and the low-pressure end. By way of example, one of the adjacent ring sections or stages may be configured with a notched portion to receive and engage the at least one intermediate flange coupling portion.

The ring section pump may include ring sections or stages configured between the low-pressure end and the high-pressure end, each ring section or stage may be configured with a casing, an impeller, a diffuser as well as other parts/components.

The at least one intermediate tie rod combination may include a high pressure intermediate tie rod combination with the upper tie rods coupling together a first set of the ring sections stages between the at least one intermediate flange and the high-pressure end.

The at least one intermediate tie rod combination may also include a lower pressure intermediate tie rod combination with the lower tie rods coupling together a second set of the ring sections or stages between the at least one intermediate flange and the low-pressure end.

The number of upper tie rods in the high pressure intermediate tie rod combination may be greater than a corresponding number of the lower tie rods in the low pressure intermediate tie rod combination, e.g., based upon the high pumping pressure experienced by the high pressure intermediate tie rod combination during normal operation, as well as depending on the pump application.

The number of the first set of the ring sections or stages coupled together in the high pressure intermediate tie rod combination may be less than the corresponding number of the second set of the ring sections or stages coupled together in the low pressure intermediate tie rod combination, e.g., depending on the pump application.

The low-pressure end may include a suction bell configured on one end of the ring section pump to receive the fluid to be pumped into the ring section pump; the high-pressure end may include a discharge casing configured on an opposite end of the ring section pump to provide the fluid to be pumped from the ring section pump and to mount the ring section pump; and the at least one intermediate flange may be configured so the upper tie rods couple together the at least one intermediate flange and the discharge casing, and so the lower tie rods couple together the at least one intermediate flange and the suction bell.

The scope of the invention is intended to include, and embodiments are envisioned in which, tie-rods are configured for spanning all stages, e.g., possibly passing through or around an intermediate flange. By way of example, embodiments may include having one set of tie-rods from the discharge flange to the intermediate flange, and another set of tie-rods from the inlet flange to the discharge flange.

By way of example, embodiments are envisioned, and the scope of the invention is also intended to include using multiple intermediate tie rod combinations. For example, a ring section pump having two intermediate tie rod combinations defining three pumping sections may be configured as follows: A first intermediate tie rod combination may include a first intermediate flange with upper tie rods configured to couple together the first intermediate flange and a high-pressure end, and with intermediate tie rods configured to couple together the first intermediate flange and a second intermediate flange that forms part of a second intermediate tie rod combination. The second intermediate tie rod combination may include lower tie rods configured to couple together the second intermediate flange and the low-pressure end. Embodiments are envisioned, and the scope of the invention is also intended to include ring section pumps having more than two intermediate tie rod combinations defining more than three pumping sections within the spirit of the underlying invention.

Embodiments are envisioned, and the scope of the invention is also intended to include apparatus featuring a low-pressure end, a high-pressure end and at least one intermediate tie rod combination. The low-pressure end may be configured to receive fluid to be processed. The high-pressure end may be configured to provide the fluid to be processed. The at least one intermediate tie rod combination may include at least one intermediate flange with upper tie rods configured to couple together the at least one intermediate flange and the high-pressure end and with lower tie rods configured to couple together the at least one intermediate flange and the low-pressure end. The apparatus may include, or take the form of such a ring section pump, as well as other types of equipment either now known or later developed in the future configured with a low-pressure end and a high-pressure end coupled together with sections or stages for processing a fluid. The apparatus may also include one or more of the other features set forth herein.

BRIEF DESCRIPTION OF THE DRAWING

The drawing, not necessarily drawn to scale, includes the following Figures:

FIG. 1A shows a perspective view of a ring section tie-rod pump having conventional tie rods arranged between low-pressure and high-pressure pump ends, e.g., that may be vertically arranged, mounted and used in relation to a sump, and that is known in the art.

FIG. 1B shows a cross-sectional view of the ring section tie-rod pump shown in FIG. 1A.

FIG. 3A shows a perspective view of a ring section tie-rod pump according to some embodiments of the present invention, having at least one intermediate flange combination with upper and lower tie rods arranged between low-pressure and high-pressure pump ends, e.g., that may be vertically arranged, mounted and used in relation to a sump.

FIG. 3B shows a cross-sectional view of the ring section tie-rod pump shown in FIG. 3A.

Figure 2A:
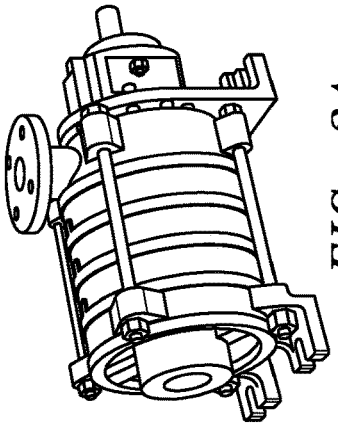
FIG. 2A show a perspective view of a ring section tie-rod pump having conventional tie rods arranged between front and back pump ends, e.g., that may be horizontally mounted and used in relation to other pumping applications.
Figure 2B:
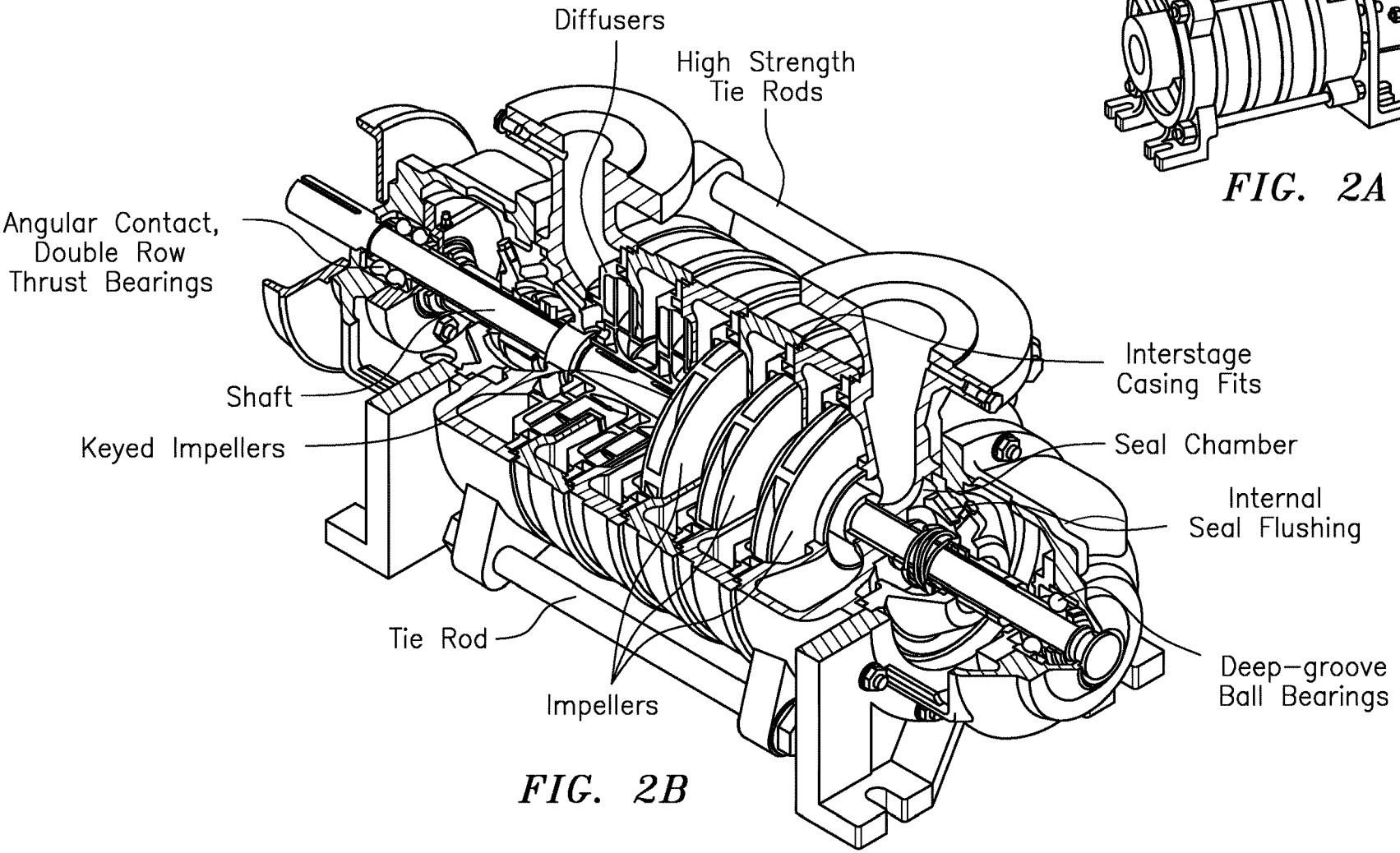
FIG. 2B show a cross-sectional view of a ring section tie-rod pump having conventional tie rods arranged between low-pressure and high-pressure pump ends, e.g., that may be horizontally mounted and used in relation to other pumping applications.

Not every reference numeral is included in every Figure, e.g., so as to reduce clutter in the drawing as a whole.

DETAILED DESCRIPTION OF THE INVENTION

FIG. 1: The Basic Apparatus 10

Figure 3C:
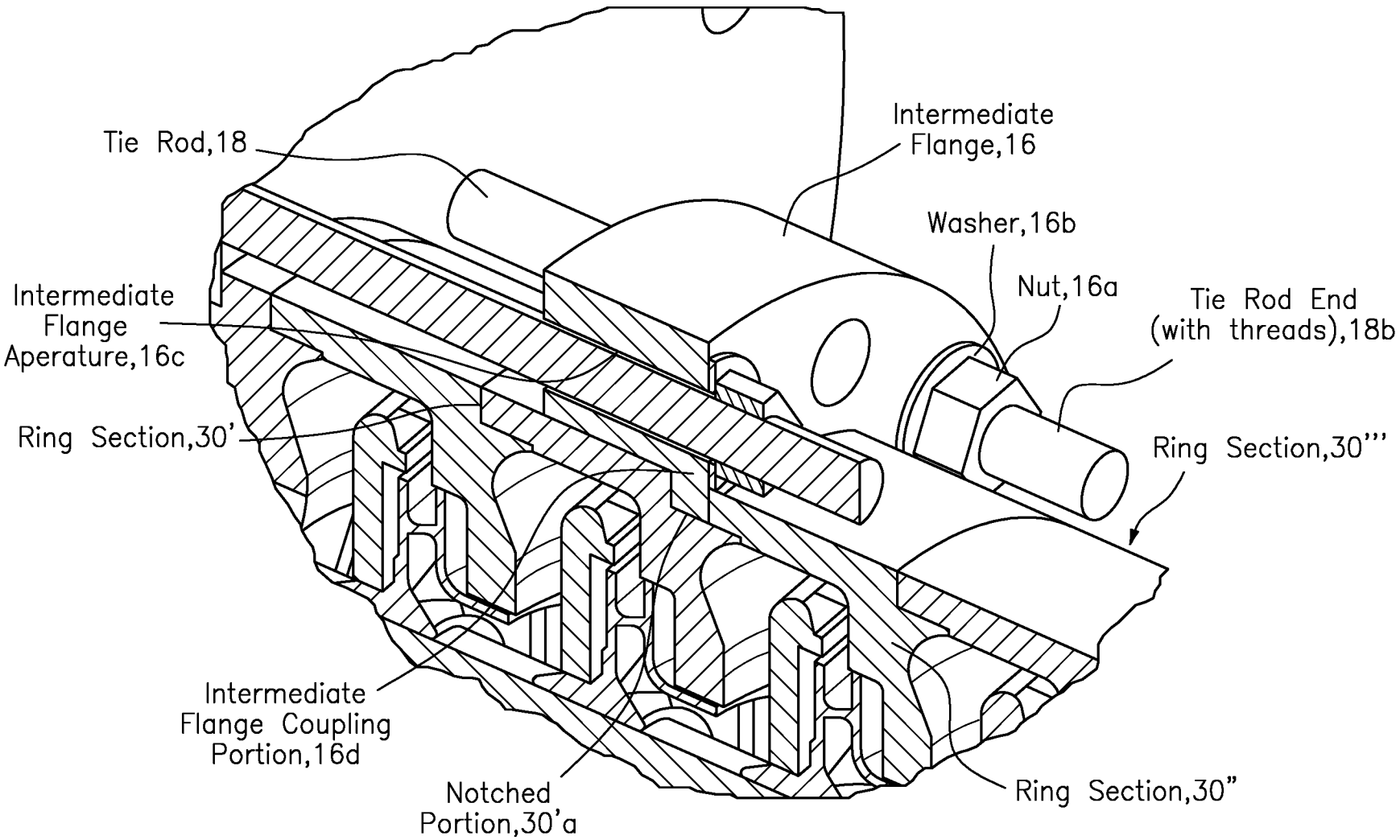
FIG. 3C shows an enlarged cross-sectional view of an intermediate part/portion of the ring section tie rod pump as circled and shown in FIG. 3B.

FIGS. 3A, 3B and 3C show the present invention in the form of apparatus 10, e.g., including a ring section pump 10, featuring

- a low-pressure end 12 configured to receive fluid to be pumped into the ring section pump 10;
- a high-pressure end 14 configured to provide the fluid to be pumped from the ring section pump 10; and
- at least one intermediate tie rod combination having at least one intermediate flange 16 with upper tie rods 18 configured to couple together the at least one intermediate flange 16 and the high-pressure end 14 and with lower tie rods 20 configured to couple together the at least one intermediate flange 16 and the low-pressure end 12.

The ring section pump 10 may include one or more of the following features:

Example of Flange-to-Flange Coupling Arrangement

Consistent with that shown in FIGS. 3A, 3B and 3C, the low-pressure end 12 may include a suction bell 12*a* and a suction bell or inlet flange 12*b;* the high-pressure end 14 may include an outlet/discharge casing or flange 14*a* and an outlet 14;and the upper tie rods 18 may couple together the at least one intermediate flange 16 and the outlet/discharge casing or flange 12*b,* and the lower tie rods 20 may couple together the at least one intermediate flange 16 and the suction bell or inlet flange 12*b.* While the present invention is disclosed using the flange-to-flange coupling arrangement, the scope of the invention is not intended to be limited to the same. For example, other embodiments are envisioned where, and the scope of the invention is intended to include, the at least one intermediate flange 16 may be coupled to other non-flange parts/components of the low-pressure end 12 and the high-pressure end 14 within the spirit of the underlying invention.

Examples of Threaded Couplings for the Upper and Lower Tie Rods

By way of example, the upper and lower tie rods 18, 20 may couple together the at least one intermediate flange 16, the outlet/discharge casing or flange 14*a* and the suction bell or inlet flange 12*b,* as follows:

The outlet/discharge casing or flange 14*a* may be configured with apertures, one of which is labeled 14*a*' (see FIG. 3B), to receive ends, one of which is labelled 18*a,* of the upper tie rods 18. By way of example, the apertures 14*a*' may be configured as threaded apertures 14*a*' (see FIG. 3B), and the ends 18*a* of the upper tie rods 18 may be configured as threaded ends 18*a* (see FIG. 3B). In the threaded combination, the threaded apertures 14*a*' of the outlet/discharge casing or flange 14*a* may be configured to receive the threaded ends 18*a* (see FIG. 3B) of the upper tie rods 18 to couple together the outlet/discharge casing or flange 14*a* and the upper tie rods 18. While the scope of the invention is disclosed using such a threaded combination to couple together the upper tie rods 18 and the outlet/discharge casing or flange 14*a,* the scope of the invention is not intended to be limited to the same. For example, other embodiments are envisioned where, and the scope of the invention is intended to include, the apertures 14*a*' in the outlet/discharge casing or flange 14*a* being configured to allow the ends 18*a* (see FIG. 3B) of the upper tie rods 18 to pass through, e.g., consistent with the nut and bolt coupling arrangement between the upper and lower tie rods 18, 20 and the at least one intermediate flange 16, as well as the nut and bolt coupling arrangement between the lower tie rods 20 and the suction bell or inlet flange 12*b,* as set forth below, and all within the spirit of the present invention.

Moreover, the suction bell or inlet flange 12*b* may be configured with corresponding apertures, one of which is labeled 12*b*' (see FIG. 3A), to receive corresponding ends, one of which is labelled 20*a* (see FIG. 3A), of the lower tie rods 20. By way of example, the corresponding ends 20*a* may be configured as threaded corresponding ends 20*a.* In this nut and bolt coupling arrangement, the corresponding aperture 12*b*' (see FIG. 3A) may be configured to allow the threaded corresponding ends 20*a* of the lower tie rods 20 to be passed through and fastened to the suction bell or inlet flange 12*b* with corresponding threaded nuts, one of which is labeled 20*a.* While the scope of the invention is disclosed using a nut and bolt coupling arrangement to couple together the lower tie rods 20 and the suction bell or inlet flange 12*a,* the scope of the invention is not intended to be limited to the same. For example, other embodiments are envisioned where, and the scope of the invention is intended to include, the corresponding apertures 12*b*' of the suction bell or inlet flange 12*a* may be configured as threaded corresponding apertures 12*b*' to receive the threaded ends 20*a* (see FIG. 3B) of the lower tie rods 20 to couple together the suction bell or inlet flange 12*a* and the lower tie rods 20, consistent with that disclosed herein, within the spirit of the present invention.

Moreover still, the at least one intermediate flange 16 may be configured with various apertures, one of which is labelled 16*c* (see FIG. 3A and 3C). The various apertures may include a first set of associated apertures like aperture 16*c* (see FIG. 3A and 3C) to receive opposing ends 18*b* (see FIG. 3B and 3C) of the upper tie rods 18 to couple together the at least one intermediate flange 16 and the outlet/discharge casing or flange 14*a.* The first set of associated apertures 16*c* may be configured to allow threaded opposing ends 18*b* of the upper tie rods 18 to be passed through and fastened to the at least one intermediate flange 16 with a first set of associated threaded nuts, one of which is labeled 16*a.* The various apertures may also include a second set of associated apertures like aperture 16*c* to receive opposing corresponding ends 20*b* (see FIG. 3A) of the lower tie rods 20 to couple together the at least one intermediate flange 16 and the inlet or suction bell flange 12*b.* The second set of associated apertures 16*c* may be configured to allow threaded opposing corresponding ends 20*b* of the lower tie rods 20 to be passed through and fastened to the at least one intermediate flange 16 with a second set of associated threaded nuts like 16*a.*

Example of Intermediate Flange Mounting Portion 16*d* (FIG. 3B and 3C)

By way of example, the at least one intermediate flange 16 may include at least one intermediate flange coupling portion 16*d* (see FIGS. 3B and 3C); and the ring section pump 10 may include adjacent ring sections or stages 30', 30", 30''' (FIG. 3C) configured to receive and engage the at least one intermediate flange coupling portion 16*d* at at least one intermediate location between the high-pressure end 14 and the low-pressure end 12. Consistent with that shown in FIG. 3C, one of the adjacent ring sections or stages 30' may be configured with a notched portion 30'*a* for receiving the at least one intermediate flange coupling portion 16*d* in relation to the other adjacent ring sections or stages 30". While the present invention is disclosed using the intermediate flange coupling portion 16*d,* the scope of the invention is not intended to be limited to the same. For example, other embodiments are envisioned where, and the scope of the invention is intended to include, the at least one intermediate flange 16 either does not include the at least one intermediate flange coupling portion 16*d,* or includes other types of kinds of arrangements for coupling the intermediate flange 16 to one or more of the ring or stages 30 (see FIG. 3A) within the spirit of the underlying invention.

Examples of High/Low Pressure Ring Section Coupling Combinations

The ring section pump 10 may include ring sections or stages 30 configured between the low-pressure end 12 and the high-pressure end 14 in relation to a pump shaft S. By way of example, each ring section or stage 30 may be configured with a casing, impeller, diffuser, as well as other parts/components, e.g., consistent with that known in the prior art. The scope of the invention is not intended to be limited to using any particular type or kind of ring sections or stages either now known or later developed in the future.

According to some embodiments of the present invention, the at least one intermediate tie rod combination may include a high pressure intermediate tie rod combination with the upper tie rods 18 coupling together a first set of the ring sections or stages 30 between the at least one intermediate flange 16 and the high-pressure end 14, and may also include a lower pressure intermediate tie rod combination with the lower tie rods 20 coupling together a second set of the ring sections or stages 30 between the at least one intermediate flange 16 and the low-pressure end 12.

Consistent with that shown in FIGS. 3A and 3B, the number of upper tie rods 18 in the high pressure intermediate tie rod combination may be greater than a corresponding number of the lower tie rods 20 in the low pressure intermediate tie rod combination, e.g., based upon the fact that the fluidic pressure increases in a substantially linear way along the length of the ring sections or stages 30 extending from the low-pressure 12 to the outlet 14, so that the pressure in the high pressure end is generally understood to be greater than the pressure in the low pressure end. As shown in FIG. 3A, the number of upper tie rods 18 is six (6), four of which are shown, that are symmetrically arranged around the ring sections or stages 30, while the number of lower tie rods 20 is four (4), two of which are shown, that are symmetrically arranged around the ring sections or stages 30. The scope of the invention is not intended to be limited to any particular number or arrangement of the upper tie rods 18 in the high pressure intermediate tie rod combination; and embodiments are envisioned having either fewer than six (6) upper tie rods 18 or greater than six (6) upper tie rods 18, e.g., depending on the pump application. Further, the scope of the invention is not intended to be limited to any particular number or arrangement of the lower tie rods 20 in the low pressure intermediate tie rod combination; and embodiments are envisioned having either fewer than four (4) lower tie rods 20 or greater than four (4) lower tie rods 20, e.g., depending on the pump application.

Moreover, consistent with that also shown in FIGS. 3A and 3B, the number of the first set of the ring sections or stages 30 coupled together in the low pressure intermediate tie rod combination may be less that the corresponding number of the second set of the ring sections or stages coupled together in the high pressure intermediate tie rod combination, e.g., depending on the particular pump application. However, the scope of the invention is not intended to be limited to any particular relationship between the first set of the ring sections or stages 30 in the low pressure intermediate tie rod combination and the second set of the ring sections or stages in the high pressure intermediate tie rod combination, e.g., including the number of rings or stages in either set.

Examples of Other Coupling Arrangements

Embodiments are envisioned, and the scope of the invention is intended to include, using at least one intermediate coupling combination having at least one intermediate flange with upper couplers configured to couple together the at least one intermediate flange and the high-pressure end and with lower couplers configured to couple together the at least one intermediate flange and the low-pressure end. In these embodiments, upper and lower couplers and suitable coupling arrangements may be used instead of upper and lower tie rod and suitable tie rod arrangements. By way of example, the upper and lower couplers may include, or take the form of, clamps and/or suitable clamping arrangements either now known or later developed in the future, which may be suitably adapted to achieve the desired coupling between the at least one intermediate flange and the high-pressure end, and the at least one intermediate flange and the low-pressure end.

The Scope of the Invention

It should be understood that, unless stated otherwise herein, any of the features, characteristics, alternatives or modifications described regarding a particular embodiment herein may also be applied, used, or incorporated with any other embodiment described herein. Also, the drawing herein is not drawn to scale.

Although the invention has been described and illustrated with respect to exemplary embodiments thereof, the foregoing and various other additions and omissions may be made therein and thereto without departing from the spirit and scope of the present invention.

What is claimed is:

1. A ring section pump comprising:

an inlet flange configured to receive fluid to be pumped into the ring section pump;

an outlet/discharge flange configured to provide the fluid to be pumped from the ring section pump; and an intermediate tie rod combination, wherein the intermediate tie rod combination includes an intermediate flange, upper tie rods, and lower tie rods, the upper tie rods directly couple the intermediate flange to the outlet/discharge flange and the lower tie rods directly couple the intermediate flange to the inlet flange.

2. A ring section pump according to claim 1, wherein:

the outlet/discharge flange is configured with apertures to receive ends of the upper tie rods;

the inlet flange is configured with corresponding apertures to receive corresponding ends of the lower tie rods; and the intermediate flange is configured with a first set of associated apertures to receive opposing ends of the upper tie rods to couple together the intermediate flange and the outlet/discharge flange, and is also configured with a second set of associated apertures to receive opposing corresponding ends of the lower tie rods to couple together the intermediate flange and the inlet flange.

3. A ring section pump according to claim 2, wherein the outlet/discharge flange is configured with threaded apertures to receive threaded ends of the upper tie rods to couple together the outlet/discharge flange and the upper tie rods.

4. A ring section pump according to claim 2, wherein the inlet flange is configured so the corresponding apertures allow threaded corresponding ends of the lower tie rods to be passed through and fastened to the inlet flange with corresponding threaded nuts.

5. A ring section pump according to claim 2, wherein the intermediate flange is configured so the first set of associated apertures allows threaded opposing ends of the upper tie rods to be passed through and fastened to the intermediate flange with a first set of associated threaded nuts.

6. A ring section pump according to claim 2, wherein the intermediate flange is configured so the second set of associated apertures allows threaded opposing corresponding ends of the lower tie rods to be passed through and fastened to the intermediate flange with a second set of associated threaded nuts.

7. A ring section pump according to claim 1, wherein:

the intermediate flange comprises at least one intermediate flange coupling portion; and the ring section pump comprises adjacent ring sections or stages configured to receive and engage the intermediate flange coupling portion at at least one intermediate location between the outlet/discharge flange and the inlet flange.

8. A ring section pump according to claim 1, wherein the number of upper tie rods is greater than a corresponding number of the lower tie rods.

9. A ring section pump comprising:

a suction bell configured on one end of the ring section pump to receive the fluid to be pumped into the ring section pump;

a discharge casing configured on an opposite end of the ring section pump to provide the fluid to be pumped from the ring section pump and to mount the ring section pump; and an intermediate tie rod combination, wherein the intermediate tie rod combination includes an intermediate flange, upper tie rods, and lower tie rods and the intermediate flange is configured so the upper tie rods directly couple the intermediate flange to the discharge casing and the lower tie rods directly couple the intermediate flange to the suction bell.

* * * * *